US007350727B2

(12) United States Patent
Kronz

(10) Patent No.: US 7,350,727 B2
(45) Date of Patent: Apr. 1, 2008

(54) ROLLER MILL, PARTICULARLY AIR-SWEPT ROLLER MILL, AND METHOD FOR GRINDING MATERIALS WITH MAGNETIZABLE, PARTICULARLY IRON-CONTAINING CONSTITUENTS, E. G. SLAG

(75) Inventor: Hartmut Kronz, Hückelhoven (DE)

(73) Assignee: Loesche GmbH, Duesseldorf (DE)

( * ) Notice: Subject to any disclaimer, the term of this patent is extended or adjusted under 35 U.S.C. 154(b) by 0 days.

(21) Appl. No.: 11/264,013

(22) Filed: Nov. 2, 2005

(65) Prior Publication Data

US 2006/0049288 A1 Mar. 9, 2006

Related U.S. Application Data

(62) Division of application No. 10/483,401, filed as application No. PCT/EP02/08309 on Jul. 25, 2002.

(30) Foreign Application Priority Data

Aug. 23, 2001 (DE) ..... 101 41 414

(51) Int. Cl.
*B02C 17/00* (2006.01)
*B02C 17/02* (2006.01)

(52) U.S. Cl. ..... 241/24.14; 241/52; 241/79.1

(58) Field of Classification Search ..... 241/19, 241/24.14, 47, 52, 79.1, 119
See application file for complete search history.

(56) References Cited

U.S. PATENT DOCUMENTS

| | | | | |
|---|---|---|---|---|
| 3,754,713 | A * | 8/1973 | Kienast et al. | 241/19 |
| 3,951,347 | A * | 4/1976 | Tiggesbaumker et al. | 241/52 |
| 4,174,508 | A * | 11/1979 | Lichtenberger | 335/202 |
| 4,295,084 | A * | 10/1981 | Nagase et al. | 318/719 |
| 4,420,390 | A * | 12/1983 | Carr | 209/216 |
| 4,803,061 | A * | 2/1989 | Najjar et al. | 423/418.2 |
| 4,896,836 | A * | 1/1990 | Mitchell | 241/81 |
| 5,244,157 | A * | 9/1993 | Brundiek | 241/36 |
| 5,975,442 | A * | 11/1999 | Purser | 241/24.14 |

FOREIGN PATENT DOCUMENTS

| | | |
|---|---|---|
| CH | 103265 | 2/1924 |
| DE | 39 21 986 C1 | 10/1990 |

* cited by examiner

*Primary Examiner*—Bena Miller
(74) *Attorney, Agent, or Firm*—Jacobson Holman PLLC

(57) ABSTRACT

The invention relates to a roller mill, particularly an air-swept roller mill provided with a device for separating magnetizable constituents, particularly iron particles from the milling area. The invention also relates to a method for grinding materials with magnetizable, particularly iron-containing constituents, e.g. slag, in an air-swept roller mill where, for avoiding concentrations of magnetizable particles, particularly iron particles, on the grinding pan, said particles are electromagnetically separated and removed from the roller mill.

8 Claims, 3 Drawing Sheets

ROLLER MILL, PARTICULARLY AIR-SWEPT ROLLER MILL, AND METHOD FOR GRINDING MATERIALS WITH MAGNETIZABLE, PARTICULARLY IRON-CONTAINING CONSTITUENTS, E. G. SLAG

This application is a divisional of application Ser. No. 10/483,401 filed Jan. 12, 2004, which in turn is a 371 of PCT/EP02/08309 filed Jul. 25, 2002.

BACKGROUND OF THE INVENTION (1) Field of the Invention

The invention relates to a roller mill, particularly an air-swept roller mill and a method for grinding materials with magnetizable, particularly iron-containing constituents.

(2) Description of Related Art

The invention is preferably intended for slag mills and for grinding granulated blast furnace slag and for use in cement milling plants, where air-swept roller mills are used for grinding cement clinker, gypsum and granulated blast furnace slag (DE 39 21 986 C1).

Granulated blast furnace slag is obtained during the production of iron during the blast furnace process and contains iron particles, which in the milling or grinding process lead to relatively high wear to the components participating in said process.

In order to minimize wear, prior to crushing, the feedstock is supplied to a magnetic separator, particularly an overbelt magnetic separator. However, this only removes constituents which are freely exposed and which are not enclosed by slag. Said constituents pass with the feedstock into the mill.

During the grinding process the iron particles are decomposed and concentrated as a result of their high specific gravity and poor millability on the grinding pan. A removal only takes place if said concentrated iron particles, as a result of centrifugal force, pass over the grinding pan edge and vane ring into the ring duct and from there into the external cycle for the so-called "external coarse particles", where they are separated from the coarse particles by magnetic separating means.

Swiss patent 103 265 discloses a method for comminuting, crushing or squeezing out random materials, in which the elements, between which the milling material undergoes the treatment, are pressed against one another with magnetic force. A description is given of roller mills in which the pressure magnetically produced between the grinding rollers is intended to reduce bearing pressures and movable masses. In the presence of magnetic components in the milling material, the wear phenomena on the grinding rollers are to be eliminated automatically after they have arisen in that the magnetic components are attracted to the elevations and comminuted, so that a greater wear occurs there compared with that in the depressions. For the separation of magnetizable substances in the milling material, additionally at least one magnetizable separating roller is located upstream or downstream of the milling or grinding clearance and cooperates with one of the two grinding rollers.

To reduce the bearing pressures in roller mills, the construction of an annular magnetic field in the milling pan is proposed. A magnetic field is to be formed by two concentric ring poles and a field coil. The grinding rollers roll on the upper ring faces. A separation of magnetizable constituents from the grinding bed and a removal of said constituents from the grinding area separate from the finished material is not intended. The disadvantages of the presence of iron particles and similar magnetizable substances in the grinding bed and in the grinding and classifying area can consequently not be avoided.

The object of the invention is to provide a roller mill, particularly an air-swept roller mill, and a method which in an extremely simple and efficient manner and without interrupting the grinding operation and while maintaining the product quality, ensure removal of the iron constituents and further metal fractions from the milling material in the grinding area.

A fundamental idea of the invention is that magnetizable particles, particularly iron particles decomposed during comminution and present on the grinding pan in the grinding area, particularly in the grinding bed, are to be removed with the aid of at least one electromagnetic device located in the grinding area and a concentration of such particles on the milling bed is avoided by extracting the particles, which can in particular take place in a continuous manner.

According to the invention, the electromagnetic device is a roller-like device rolling on the grinding bed and which is constructed in such a way that the magnetizable, particularly iron particles of the grinding bed adhere to the surface. With the aid of a discharge mechanism, which is connected to the roller-like, electromagnetic device and cooperates therewith, the separated, magnetizable constituents are removed from the roller-like device and discharged from the grinding area. The use of at least one roller-like, electromagnetic device rolling on the grinding bed is advantageous for a troublefree, efficient grinding process due to the low frictional resistance and the simultaneously smoothing and compacting action.

In principle, the electromagnetic device can also be positioned above the grinding bed and provided with an adjustable gap between a jacket of the roller-like device and the grinding pan.

In roller mills, which are e.g. used as overflow mills and have no integrated classifier, a grinding roller can also be constructed for electromagnetic separation. Through the removal of the iron particles, which hereinafter is also understood to cover other magnetizable particles, wear to grinding rollers and grinding pans is reduced and the service life increased.

It is particularly advantageous to install at least one electromagnetic device in air-swept roller mills having at least one pair of rollers and in general two or three pairs of rollers. A pair of rollers comprises a grinding roller, also known as the master roller, as well as an auxiliary roller, also known as the slave roller and which is located upstream of the master roller and which prepares the grinding bed, particularly compacting and rendering the same uniform and which particularly with hard and brittle materials ensures an optimized, vibration-free milling.

It is appropriate to construct at least one slave roller for the electromagnetic separation of magnetizable constituents, particularly iron particles, from the grinding bed and to connect it to a discharge mechanism with which said disturbing constituents can be removed from the grinding area.

In an advantageous development the slave roller has a nonmagnetic roller jacket and in the interior a regulatable electromagnet, preferably with-an iron core and electrical coils, whose shaping and arrangements are adapted to the roller shape over a predetermined area of the roller jacket in order to build up an effective magnetic field. If, considered in circular cross-section, the iron core extends roughly over an angle between 240 and 270°, the necessary extraction and adhesion of the particles and the subsequent detachment and removal are ensured.

The current supply for the electrical coils appropriately takes place in the vicinity of the roller axis. In addition, for regulating the electromagnet a thyristor circuit is advantageously provided.

The discharge mechanism for removing the metal particles separated on the electromagnetic device and in particular the iron particles is appropriately constructed in such a way that the separated particles are continuously conveyed out of the milling area and can e.g. be fed by means of the vane ring into an area located below the same.

It is particularly advantageous to use a discharge mechanism having a stripper, a conveyor trough and a downcomer. The stripper can have a ledge-like construction and appropriately extends at least over the width of the rolling face of the electromagnetic device, e.g. the jacket of a slave roller. For a troublefree acceptance of the particles, it is also appropriate for the stripper to be arranged in parallel and at an adjustable distance from the roller jacket of the electromagnetically constructed slave roller.

Appropriately the stripper is fixed in detachable and/or vertically adjustable manner to the conveyor trough. In an alternative construction the stripper and conveyor trough form a unit. The conveyor trough with stripper arranged in the defined manner are then advantageously fixed in such a way that a height adjustment and a variation to the gap between the stripper and electromagnetic roller is possible.

In principle, the stripper and/or conveyor trough can be fixed to the mill casing.

However, for particularly efficient iron separation it is advantageous to fix to the slave roller with an electromagnet, e.g. in the vicinity of the rocking lever or roller axis. The stripper and/or conveyor trough then follow the movement of the slave roller and are moved up and down therewith on the grinding bed.

The conveyor trough appropriately has a gradient in the direction of an opening in the vane ring, so that the stripped particles are conveyed as a result of gravity action and, e.g. by means of a downcomer located in an opening in the vane ring, pass into the ring duct or an area below the vane ring.

To prevent a gas flow from the ring duct in the downcomer, it is appropriate to close the latter with a regulatable shutoff means. It is e.g. possible to install a weighted pendulum flap, which in the case of a predeterminable loading is swung up in the ring duct direction through dropped particles.

The inventive method for milling materials with magnetizable, particularly iron-containing constituents, e.g. slag, comprises in addition to an electromagnetic separation prior to the grinding process, a further electromagnetic separation takes place in the grinding area of a roller mill, particularly an air-swept roller mill, in order to extract the particles decomposed and left free during the grinding process and prevent a concentration of said particles on the grinding pan.

According to the invention electromagnetic separation is carried out in the grinding area with the aid of a roller-like device, particularly a slave roller. In addition to the grinding bed preparation, it is possible with at least one roller-like electromagnetic device rolling on the grinding bed and e.g. a slave roller provided with a regulatable electromagnet to bring about an extraction of the magnetizable particles, particularly iron particles from the grinding bed and grinding area. A continuous separation on the electromagnetically constructed slave roller can be performed in a particularly advantageous manner.

The particles separated on the electromagnetically constructed slave roller are then advantageously stripped with the aid of a corresponding discharge mechanism, supplied by means of the vane ring to the ring duct of the air-swept roller mill and discharged from the latter together with the coarse particles hurled over the grinding pan edge and entering the annular space and are mechanically conveyed, particularly with a revolving bucket conveyor to the feed mechanism, e.g. to a weighing belt for the feedstock. In order to separate the metal particles from the coarse particles, a further metal separation and in particular an electromagnetic separation takes place. The coarse particles are then generally returned together with the new feedstock to the air-swept roller mill.

Appropriately the electromagnetic device in the slave roller is regulated by means of a thyristor circuit and the mill is started up initially in a normal manner, i.e. without switching on the electromagnet, and only following the putting into operation of the control loop for the slave roller speed is the electromagnet switched on. In principle, the electromagnet can be regulated by means of the slave roller speed signal.

The advantages of the roller mill or air-swept roller mill according to the invention and the method according to the invention are that a continuous and regulatable separation of the magnetizable constituents, particularly the iron particles, can be carried out during the grinding process and removal from the grinding area can take place without interrupting milling operation.

When using an auxiliary or slave roller the advantage is that essentially existing component means can be used. As a result of the continuous separation and discharge from the grinding area and the area below the milling or grinding pan, there is overall a reduced external cycle and it is possible to make smaller the plant for the coarse particles to be returned, also known as the reject plant. In addition, the separated, discharged iron particles are suitable for use as a sand blasting material. Another important advantage is the avoidance of wear phenomena on the master rollers, slave rollers and on the grinding path, together with the repair costs, idle times, etc. associated therewith.

BRIEF DESCRIPTION OF THE DRAWINGS

The invention is described in greater detail hereinafter relative to the diagrammatic drawings, wherein show.

DETAILED DESCRIPTION OF THE INVENTION

Figure 1:
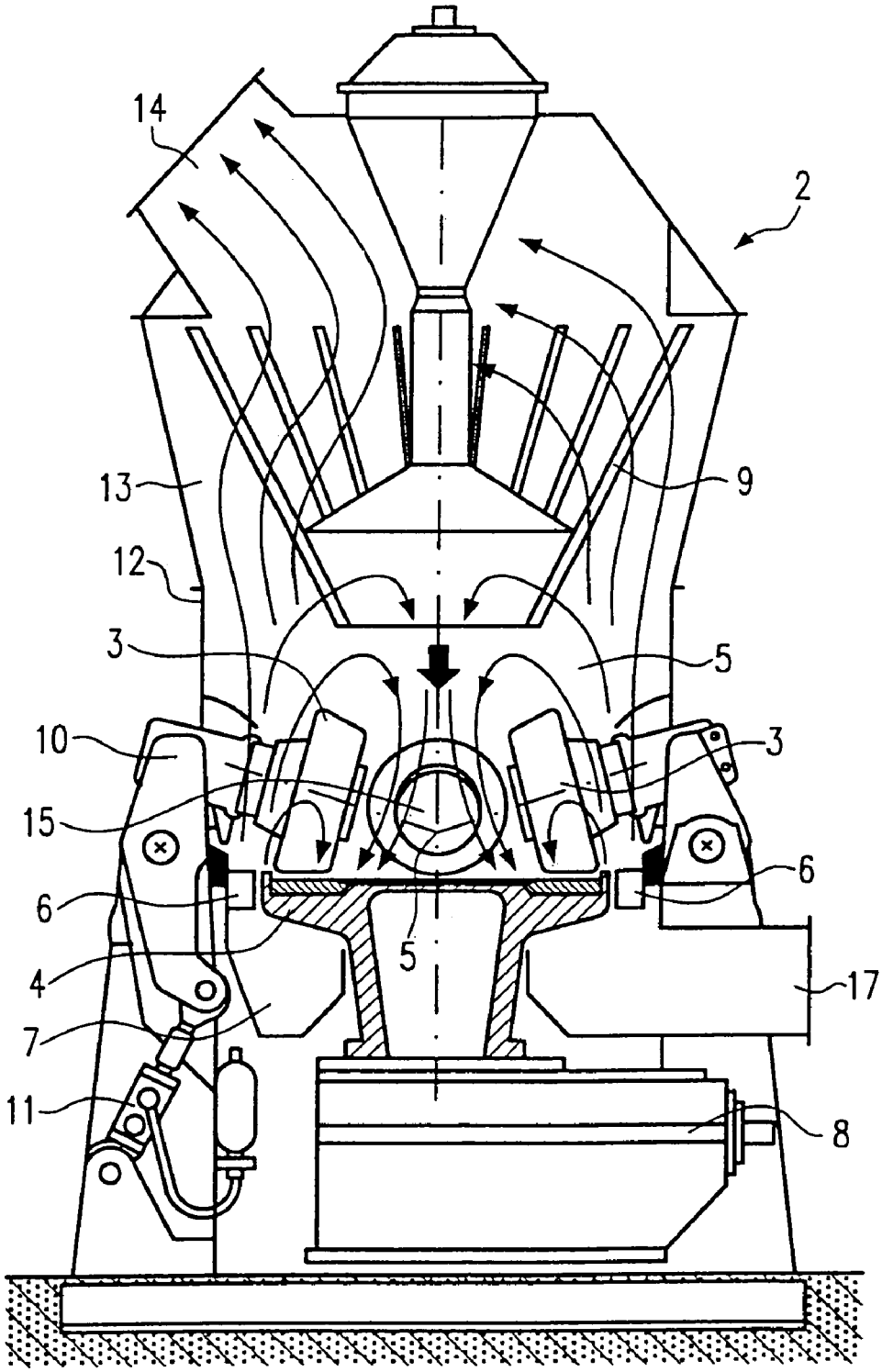
FIG. 1 A conventional air-swept roller mill with a slave roller.

FIG. 1 shows a LOESCHE air-swept roller mill 2, which is more particularly intended for the grinding of cement and granulated blast furnace slag and which is equipped with two roller pairs 3, 15. In order not to overcomplicate representation, FIG. 1 shows two grinding rollers 3, but only one auxiliary roller 15. However, FIG. 2 shows the two roller pairs, which in each case comprise one grinding roller or master roller 3 and one auxiliary roller or slave roller 15.

The master rollers 3 and slave rollers 15 roll on a grinding bed, which is formed by the feedstock on a grinding path of a rotating grinding pan 4. The grinding pan 4 is rotated by means of a drive 8 and is surrounded by a vane ring 6 by means of which a gas flow, particularly an air flow flows from a ring duct 7 into the milling area 5. The feedstock, e.g. blast furnace slag or a mixture of cement clinker, gypsum and slag, is fed by means of dosing or proportioning mechanisms, a magnetic separator and a not shown feed mechanism to the air-swept roller mill, then passes onto the grinding pan 4 and is comminuted between the resiliently pressed master rollers 3 and grinding pan 4. The air flowing into the milling area 5 through the vane ring 6 by means of a supply duct 17 and the ring duct 7 conveys the mixture of fine and coarse material into a classifying area 13 and into the vicinity of a classifier 9. Coarse material is rejected and drops back onto the grinding pan 4, whilst fine material is discharged by means of a fine material discharge 14. FIG. 1 also shows the mill casing 12, the rocking levers 10 of the two master rollers 3 and a hydraulic cylinder mechanism 11 in the case of the left-hand master roller 3, which brings about the resilient pressing action of said master rollers 3.

Figure 2:
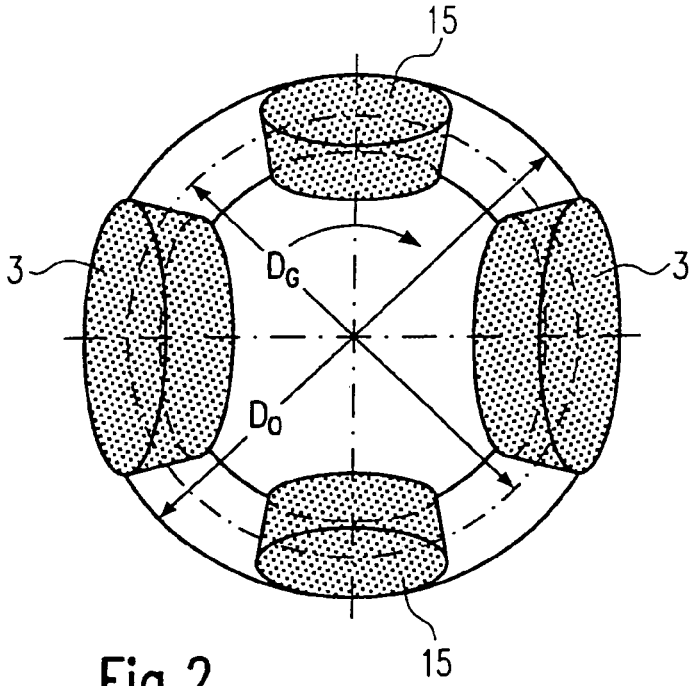
FIG. 2 A highly diagrammatic plan view of the grinding pan of the air-swept roller mill of FIG. 1.

In the embodiment according to FIGS. 1 and 2, the slave rollers 15 have a smaller diameter than the master rollers 3 and unlike the latter are not subject to a force and instead rest under their own weight on the milling bed leading to a purely rolling movement or a rolling movement superimposed by a planned sliding action. Each slave roller 15 prepares the milling bed for the master roller 3 located behind the slave roller 15 considered in the rotation direction of the milling pan 4 and this leads to the comminution of the milling material.

Reference is made to German patent 39 21 986 regarding the construction, arrangement and action of the slave rollers.

FIG. 2 shows that the slave roller 15, like the master rollers 3, has a conical construction and the width thereof roughly corresponds to the grinding path width.

At least one slave roller 15 is constructed for the electromagnetic separation of magnetizable fractions, particularly iron fractions, from the grinding material to be comminuted, in order to prevent concentration of said constituents on the grinding pan 4 and the associated wear to the milling means.

Figure 3:
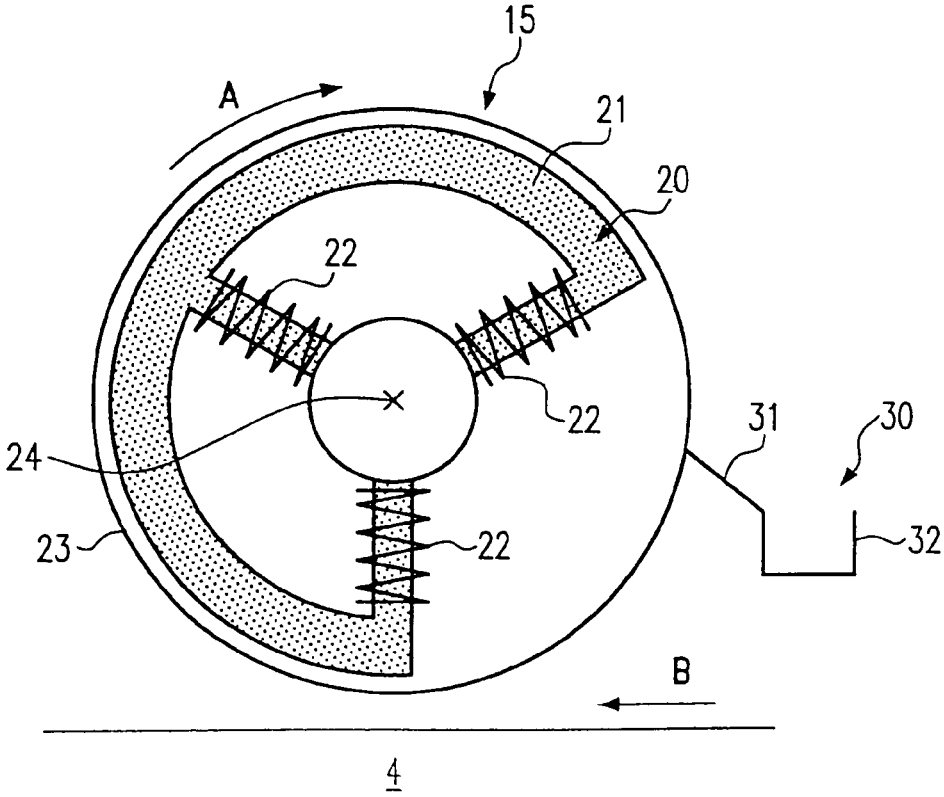
FIG. 3 A highly diagrammatic cross-section through an electromagnetically constructed slave roller with discharge mechanism.

FIG. 3 shows in cross-section a slave roller 15 constructed for electromagnetic separation. Arrow A indicates the rotation direction of slave roller 15 and arrow B the direction of the rotating grinding pan 4. The grinding material to be comminuted or the grinding bed is not shown. The slave roller 15 has a roller jacket 23 made from nonmagnetic material and is internally provided with an iron core 21 and electrical coils 22. The iron core 21 is adapted to the conically constructed roller jacket 23 of the slave roller 15 and, considered in cross-section, roughly extends over two thirds of the shell surface, so that the metal, particularly iron particles to be removed, are received from the grinding bed on the grinding pan 4 and, adhering to the rotating roller jacket 23, are conveyed to a discharge mechanism 30. The discharge mechanism 30 can be seen in FIG. 4. FIG. 3 shows a stripper 31 and a conveyor trough 32 in highly diagrammatic form.

The electromagnetic device 20 in the interior of the slave roller 15 has three electrical coils 22 arranged radially with an angular distance of approximately 120° and together with the iron core 21 form the stationary electromagnet through which the iron particles on the milling pans are attracted and, adhering to the rotary roller jacket 23, are passed to a magnet-free area and the discharge mechanism 30 positioned there.

It is also possible to construct the electromagnetic device 20 and roller jacket 23 as a rotary unit and as a function of the magnetic field strength to so construct and position the stripper that a release of particles is ensured.

Figure 4:
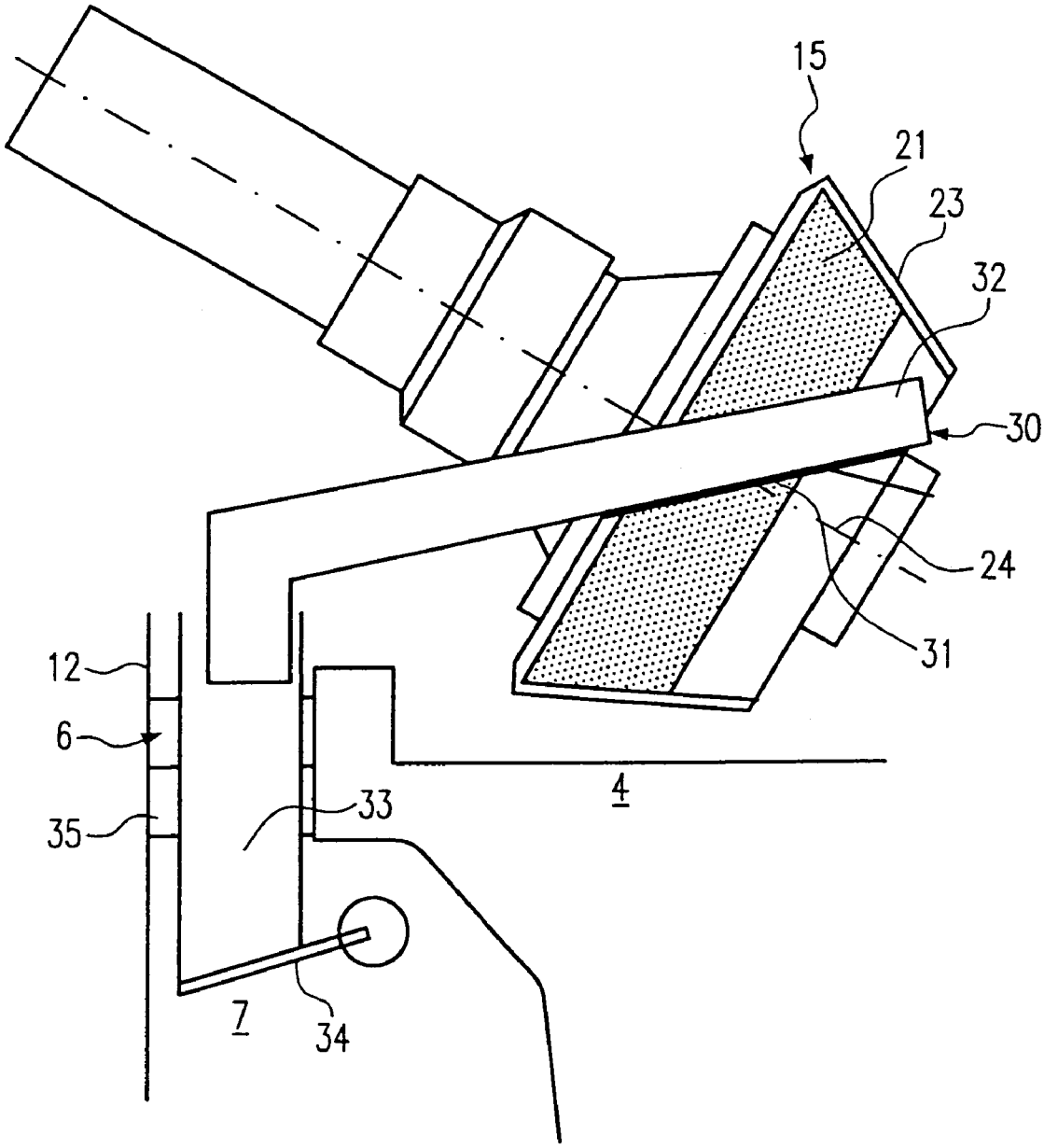
FIG. 4 A detail of an air-swept roller mill with an electromagnetically constructed slave roller and discharge mechanism.

FIG. 4 shows the conically shaped iron core 21 close to the roller jacket 23 of the slave roller 15 and the arrangement of the stripper 31 on the conveyor trough 30. The stripper 31 has a ledge-shaped construction and is fixed to the conveyor trough 32 in parallel and with a limited spacing from the roller jacket 23.

The conveyor trough 32 has a slight gradient in the direction of the mill casing 12 or vane ring 6 and issues into a downcomer 33. The downcomer is located in an opening 35 of the vane ring 6 and extends up to the ring duct 7. Fixing of the downcomer 33 can take place by means of fixing elements in the vicinity of neighbouring vanes of the vane ring 6 or to the mill casing 12. At the lower end the downcomer 33 is provided with a closing flap 34 constructed as a weighted pendulum flap.

The magnetized particles and in particular iron particles separated on slave roller 15 are only retained in the vicinity of the iron core 21 and subsequently pass via stripper 31 into the conveyor through 32, then into the downcomer 33 and ring duct 7. The coarse material particles not picked up by the master rollers 3 for comminuting purposes and which have not passed in the air flow to the classifier 9 collect in the ring duct 7 or a space below the milling area.

Together with said coarse particles, the separated iron particles are discharged from the air-swept roller mill 2 and are generally separated from the coarse particles on a weighing belt with metal separator, which is supplied again to the air-swept roller mill together with the new feedstock (not shown).

The invention claimed is:

1. A roller mill operating on a grinding material containing magnetizable constituents, the roller mill comprising:

a mill casing defining a milling area;

a grinding pan having a grinding path, the grinding pan rotatably mounted in the milling area;

at least one grinding roller in the milling area of the mill casing for rolling on the grinding material on the grinding path of the grinding pan;

slave rollers located upstream of the at least one grinding roller and rolling on the grinding material for preparing the grinding material, wherein one of the slave rollers is a roller including an electromagnetic device for separating the magnetizable constituents from the milling area, the roller including the electromagnetic device having a roller-like construction for rolling on the grinding material for separating the magnetizable constituents from the grinding material and including a nonmagnetic roller jacket and an interior, wherein the electromagnetic device has an adjustable electromagnet having an iron core and electrical coils which are located in the interior of the nonmagnetic roller jacket;

an integrated classifier above the milling area;

a vane ring located between the grinding pan and the mill casing;

a ring duct below the vane ring; and a discharge mechanism connected to the electromagnetic device for removing the separated, magnetizable constituents from the milling area, wherein the discharge mechanism removes the separated, magnetizable constituents from the roller including the electromagnetic device and discharges the same from the milling area, the discharge mechanism including at least one stripper near the roller jacket, a downcomer downstream of the stripper, a closing flag for gas flow from the ring duct provided in the downcomer, and a conveyor trough between the stripper and the downcomer.

2. The roller mill according to claim 1, further comprising:

a power supply connected to the electrical coils in the vicinity of an axis of the roller including the electromagnetic device; and a thyristor circuit for regulating the electromagnetic device.

3. The roller mill according to claim 1, wherein the closing flap in the downcomer comprises a weighted pendulum flap.

4. The roller mill according to claim 1, wherein the stripper and the conveyor trough are arranged in vertically adjustable manner.

5. The roller mill according to claim 1, wherein the stripper and the conveyor trough are fixed to the roller axis of the roller that includes the electromagnetic device.

6. The roller mill according to claim 1, further comprising electrical lines connected to the electromagnetic device, which lines are guided in the vicinity of the axis of the roller including the electromagnetic device.

7. The roller mill according to claim 1, further comprising;

a control loop for measuring a speed of the roller including the electromagnetic device for initially starting the roller mill and switching the electromagnetic device on as a function of the measured speed of the roller including the electromagnetic device.

8. A roller mill operating on a grinding material containing magnetizable constituents, the roller mill comprising:

a mill casing defining a milling area;

a grinding pan having a grinding path, the grinding pan rotatably mounted in the milling area;

at least one grinding roller in the milling area of the mill casing for rolling on the grinding material on the grinding path of the grinding pan;

slave rollers located upstream of the at least one grinding roller and rolling on the grinding material for preparing the grinding material, wherein one of the slave rollers is a roller including an electromagnetic device for separating the magnetizable constituents from the milling area, the roller including the electromagnetic device having a roller-like construction for rolling on the grinding material for separating the magnetizable constituents from the grinding material and including a nonmagnetic roller jacket and an interior, wherein the electromagnetic device has an adjustable electromagnet having an iron core and electrical coils which are located in the interior of the nonmagnetic roller jacket;

an integrated classifier above the milling area;

a vane ring located between the grinding pan and the mill casing;

a ring duct below the vane ring; and a discharge mechanism connected to the electromagnetic device for removing the separated, magnetizable constituents from the milling area, wherein the discharge mechanism removes the separated, magnetizable constituents from the roller including the electromagnetic device and discharges the same from the milling area, the discharge mechanism including at least one stripper near the roller jacket, a downcomer downstream of the stripper, and a conveyor trough between the stripper and the downcomer, wherein the stripper is ledge-shaped and is positioned with a limited spacing from the roller jacket of the roller including the electromagnetic device on the conveyor trough and the conveyor trough extends essentially to the vane ring, and wherein an opening is formed in the vane ring and the downcomer extends through the opening and connects the conveyor trough to the ring duct.

* * * * *